US009976373B2

(12) United States Patent
Araujo et al.

(10) Patent No.: US 9,976,373 B2
(45) Date of Patent: May 22, 2018

(54) BLOWOUT PREVENTER WITH SHEAR RAM

(71) Applicant: Cameron International Corporation, Houston, TX (US)

(72) Inventors: Raul Araujo, Cypress, TX (US); Jeffrey Lambert, Tomball, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 275 days.

(21) Appl. No.: 14/843,748

(22) Filed: Sep. 2, 2015

(65) Prior Publication Data

US 2017/0058627 A1 Mar. 2, 2017

(51) Int. Cl.
*E21B 33/06* (2006.01)

(52) U.S. Cl.
CPC ..... *E21B 33/063* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,975,761 | B2 * | 7/2011 | Berckenhoff | E21B 33/062 166/85.4 |
| 8,807,219 | B2 * | 8/2014 | Springett | E21B 33/063 166/298 |
| 2008/0135791 | A1 | 6/2008 | Juda et al. | |
| 2010/0155086 | A1 | 6/2010 | Berckenhoff et al. | |
| 2010/0319906 | A1 * | 12/2010 | Van Winkle | E21B 33/063 166/85.4 |
| 2012/0199762 | A1 | 8/2012 | Schaeper | |
| 2013/0299172 | A1 | 11/2013 | van Winkle | |
| 2014/0048245 | A1 * | 2/2014 | Yendell | E21B 33/063 166/55 |
| 2014/0110611 | A1 * | 4/2014 | McClanahan | E21B 33/063 251/1.3 |

FOREIGN PATENT DOCUMENTS

| | | |
|---|---|---|
| WO | 2012042269 | 4/2012 |

OTHER PUBLICATIONS

International Search Report and Written Opinion of PCT Application No. PCT/US2016/048652 dated Dec. 5, 2016: pp. 1-15.

* cited by examiner

*Primary Examiner* — Kyle Armstrong
(74) *Attorney, Agent, or Firm* — Helene Raybaud

(57) ABSTRACT

A blowout preventer may be used for shearing an object positioned in a vertical bore extending through the blowout preventer. The blowout preventer includes a shear ram movable towards the tubular, the shear ram including a biasing mechanism for biasing against an interior surface of the blowout preventer body. In this way, the biasing mechanism urges the shear ram into axial engagement with an opposing shear ram movable towards the tubular during shearing operations. The biasing mechanism comprises a biasing member, such as a coiled spring, coned-disc spring, and/or coned-disc washer which urges the biasing mechanism into contact with the inner portion of the blowout preventer body.

19 Claims, 4 Drawing Sheets

BLOWOUT PREVENTER WITH SHEAR RAM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Blowout preventers are used extensively throughout the oil and gas industry. Typical blowout preventers are used as a large specialized valve or similar mechanical device that seal, control, and monitor oil and gas wells. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the drill pipe and the sealing of the blowout preventer. Typically, a blowout preventer stack may be secured to a wellhead and may provide a safe means for sealing the well in the event of a system failure.

A typical blowout preventer includes a main body with a vertical bore. Ram bonnet assemblies may be bolted to opposing sides of the main body using a number of high tensile bolts or studs. These bolts are required to hold the bonnet in position to enable the sealing arrangements to work effectively. Typically an elastomeric sealing element is used between the ram bonnet and the main body. There are several configurations, but essentially they are all directed to preventing a leakage bypass between the mating faces of the ram bonnet and the main body. Each bonnet assembly includes a piston which is laterally movable within a ram cavity of the bonnet assembly by pressurized hydraulic fluid acting on one side of the piston. The opposite side of each piston has a connecting rod attached thereto which in turn has a shear ram and corresponding blades mounted thereon.

These rams are designed to move laterally toward the vertical bore of the blowout preventer to shear or cut any object located therein. For instance, the rams can close in on and shear a tubular within the vertical bore of the blowout preventer, such as a section of drill pipe used during drilling operations. The opposing rams typically experience some axial separation after shearing, particularly when shearing a larger object such as a tool joint. The axial separation results from shear forces encountered when shearing the larger object, leaving a vertical gap between the opposing shear blades.

After shearing, the rams can be withdrawn from the bore to allow for operations to once again be conducted through the blowout preventer bore. As an example, tools may be lowered through the blowout preventer bore on wireline. In some instances, the rams may be needed again to shear or cut the wireline located in the blowout preventer bore. This can be difficult, especially if wireline needs to be cut by rams that experienced axial separation during shearing of a tubular, because wireline tends to stretch rather than cleanly shear when the rams are closed.

Accordingly, a mechanism for enabling shear rams to more efficiently shear an object located in a blowout preventer bore, such as wireline, after previously shearing one or more other objects is desirable.

DESCRIPTION OF THE DRAWINGS

For a detailed description of the preferred embodiments of the present disclosure, reference will now be made to the accompanying drawings in which.

DETAILED DESCRIPTION

Figure 1A:
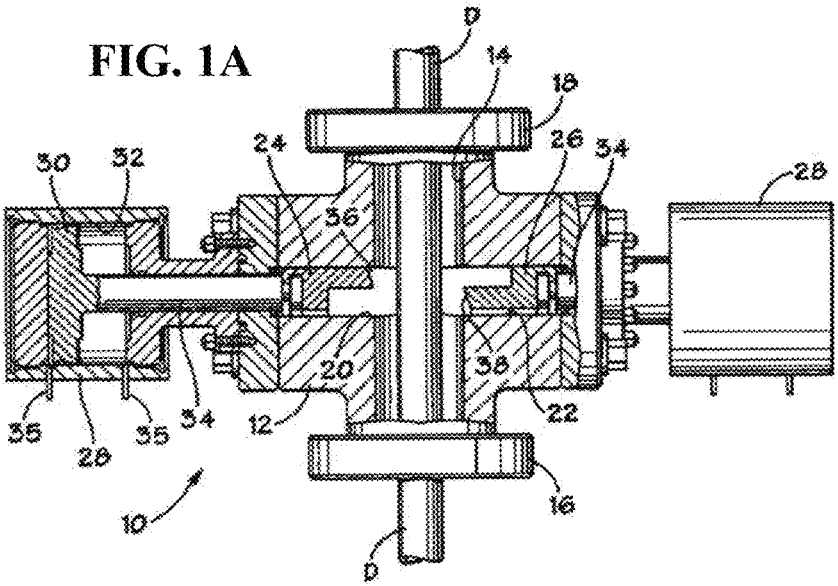
FIGS. 1A-1C show multiple cross-sectional views of a blowout preventer for shearing a tubular in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Figure 1B:
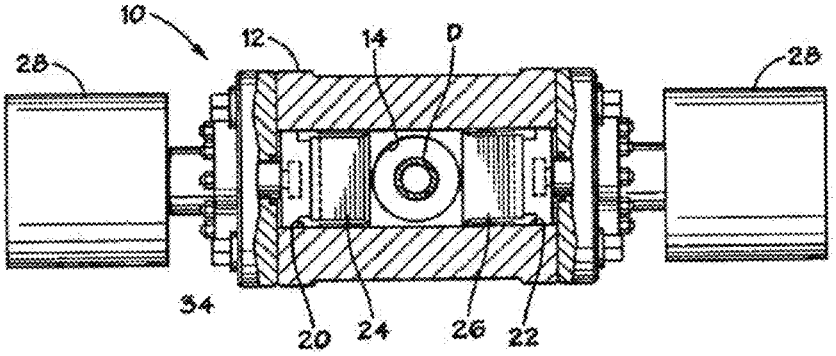
Figure 1C:
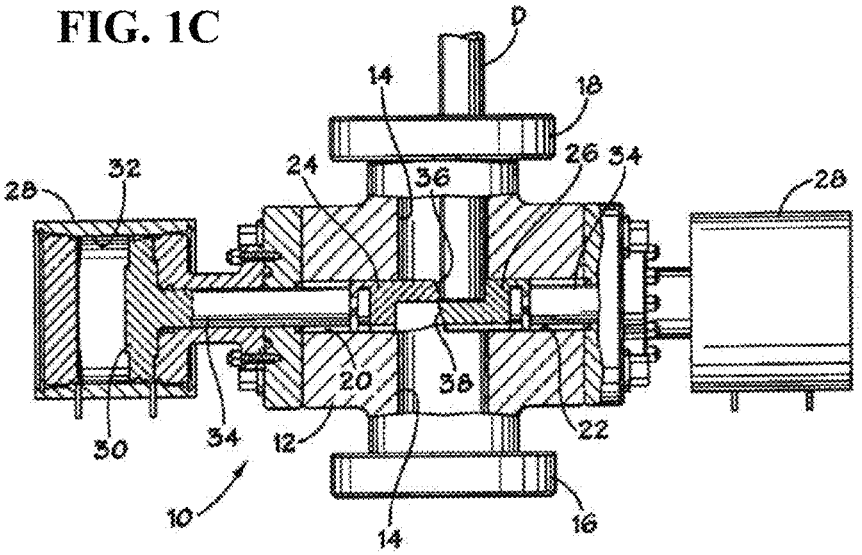

Referring now to FIGS. 1A-1C, multiple views of a blowout preventer ("blowout preventer") 10 for shearing a tubular D in accordance with one or more embodiments of the present disclosure are shown. Blowout preventer 10, which may be referred to as a ram blowout preventer or shear ram blowout preventer, includes a body 12 with a vertical bore 14 formed and/or extending through the body 12. As shown, the body 12 may include a lower flange 16 and/or an upper flange 18, such as to facilitate connecting blowout preventer 10 to other blowout preventers and/or other components, such as a wellhead connector on the flower flange 16 or to a lower marine riser package on the upper flange 18. Ram cavities and/or guideways 20 and 22 may be formed within the body 12 of blowout preventer 10, in which the guideways 20 and 22 may extend outwardly from the bore 14 and/or be formed on opposite sides of the blowout preventer bore 14.

Blowout preventer 10 may include one or more ram assemblies, such as a first ram 24 and a second ram 26. The first ram 24 may be positioned and movable within the first guideway 20 and a second ram 26 positioned and movable within the second guideway 22, such as by having the first ram 24 and/or the second ram 26 movable towards and away from the tubular D. One or more actuators 28 may be provided to move the first ram 24 and/or the second ram 26, such as for moving the first ram 24 and/or the second ram 26 into blowout preventer bore 14 to shear the portion of the tubular D extending through blowout preventer bore 14.

In this embodiment, a hydraulic actuator is shown, though any type of actuator (e.g., pneumatic, electrical, mechanical) may be used in accordance with the present disclosure. As such, actuators 28 shown in this embodiment may include a piston 30 positioned within a cylinder 32 and a rod 34 connecting the piston 30 to each respective ram 24 and 26. Further, pressurized fluid may be introduced and fluidly communicated on opposite sides of the piston 30 through ports 35, thereby enabling the actuator 28 to move the rams 24 and 26 in response to fluid pressure.

A first (e.g., upper) blade 36 may be included with or connected to the first ram 24, and a second (e.g., lower) blade 38 may be included with or connected to the second ram 26. The first and second blades 36 and 38 may be formed and positioned such that a cutting edge of the second blade 38 passes below a cutting edge of the first blade 36 in shearing of a section of a tubular D. The shearing action of first and second blades 36 and 38 may shear the tubular D. The lower portion of the tubular D may then drop into the well bore (not shown) below blowout preventer 10, or the lower portion of tubular D may hung off a lower set of rams (not shown).

Accordingly, disclosed herein are a blowout preventer apparatus and/or a ram for a blowout preventer apparatus for shearing an object located therein. The object may be positioned within the bore extending through the blowout preventer, in which the blowout preventer may be actuated to move one or more rams to engage and shear the object. A ram of a blowout preventer in accordance with the present disclosure may be used for shearing one or more different types of objects that may have different shapes, sizes, thicknesses, and other dimensions and properties.

For example, an object may include a drill pipe joint, a casing joint, a tool joint, or a wireline, in which a blowout preventer in accordance with the present disclosure may be used to shear each of these different types of objects. These objects may be sheared with or without replacement of any ram of the blowout preventer, i.e., a single ram, or a pair of opposing rams, may be used to shear multiple objects in succession. To aid the ram in shearing multiple objects in succession, the present disclosure provides for a biasing mechanism affixed to the ram to help bias the ram against an interior of a blowout preventer body to improve axial engagement with an opposing ram.

Figure 2:
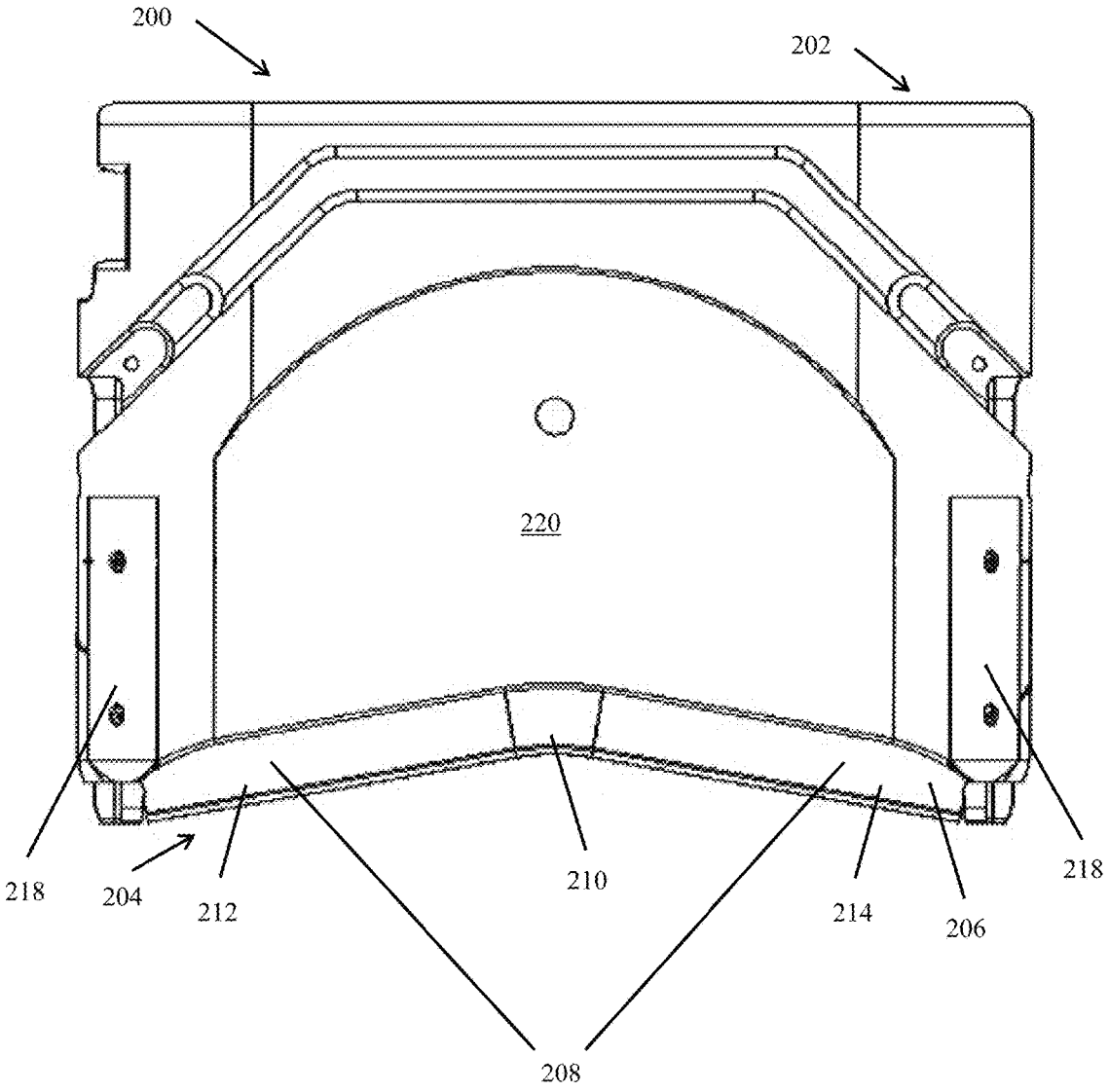
FIG. 2 shows a top view of a blowout preventer shear ram including a biasing mechanism.

Referring now to FIG. 2, a top view of a blowout preventer shear ram 200 including a biasing mechanism 218 is shown for illustrative purposes. Blowout preventer shear ram 200 is similar to ram 24 illustrated in FIGS. 1A through 1C. Blowout preventer shear ram 200 comprises a ram body 220 which includes a ram back 202 and a ram front 204. Ram back 202 is generally configured to receive a connector rod (not shown), such as a rod 34 (shown in FIGS. 1A-1C), to move shear ram 200 into and out of a blowout preventer bore. Ram front 204 includes a cutting face or blade 206 configured to shear an object located in a blowout preventer bore.

Blade 206 in accordance with the present disclosure may include one or more cutting profiles formed thereon or included therewith. As such, blade 206 may include an outer cutting profile 208 and an inner cutting profile 210. The inner cutting profile 210 may be positioned within or between portions of the outer cutting profile 208. For example, the outer cutting profile 208 may include a first blade portion 212 and a second blade portion 214, in which inner cutting profile 210 is positioned between the blade portions 212 and 214 such that the blade portions 212 and 214 are positioned on opposite sides of the inner cutting profile 210. In one or more other embodiments, blade 206 can include one integral, continuous blade portion.

Ram 200 may further include a packer channel 216 which would house a ram packer (not shown) for sealing the blowout preventer bore. Packer channel 216 and the corresponding ram packer serve to contain pressure generated when the packer of the ram 200 is forced together with a corresponding packer contained on an opposed ram. In this way, the packers allow for pressure to be controlled across the vertical bore of the BOP.

Ram 200 may further include one or more biasing mechanisms 218 located on an outer surface of ram body 220. Although represented with a generally rectangular profile, biasing mechanisms 218 can include any geometrical profile. In the illustrated embodiment, two biasing mechanisms 218 are shown located adjacent the front end 204 of ram body 220. Although only two biasing mechanisms 218 are shown in FIG. 2, any number of biasing mechanisms 218 may be located on the outer surface of ram body 220. For instance, ram body 220 can include one biasing mechanism 218, two biasing mechanisms 218, three biasing mechanisms 218, and so on, and biasing mechanisms 218 can be located adjacent the front end 204 or ram body 220, near the center of ram body 220, near the back end 202 of ram body 220, or any other position on ram body 220. Biasing mechanisms 218 are shown located on a top portion of ram body 220 and on opposing sides of ram body 220. However, biasing mechanism 218 can be located on any outer surface or combination of outer surfaces of ram body 220. For instance, biasing mechanisms 218 can be located on top of, below, or on the sides of ram body 220, or any combination thereof. Biasing mechanisms 218 are configured to bias against an interior of a blowout preventer body when ram 200 is located within a blowout preventer body.

Figure 3:
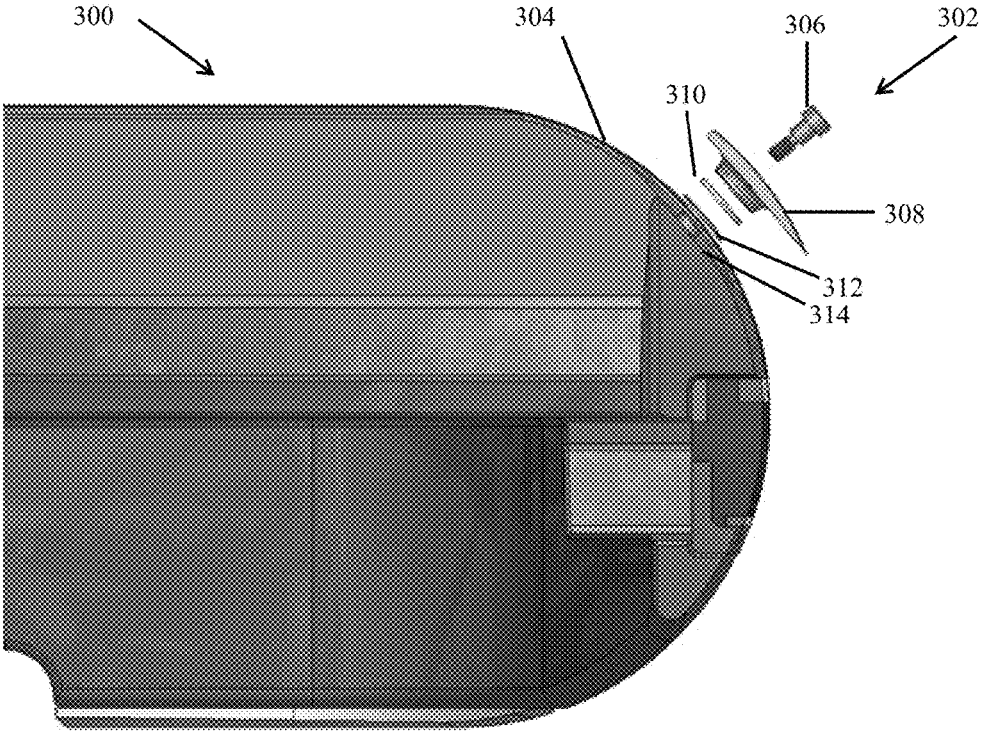
FIG. 3 shows a front elevation view of a blowout preventer shear ram including an exploded view of a biasing mechanism contained thereon.

Referring now to FIG. 3, a front elevation view of a blowout preventer ram 300 with a biasing mechanism 302 in an exploded view is shown for illustrative purposes. Blowout preventer ram 300 is similar to ram 24 illustrated in FIGS. 1A through 1C and to blowout preventer ram 200 illustrated in FIG. 2. Blowout preventer ram 300 includes biasing mechanism 302 located on a radiused edge 304 of blowout preventer ram 300. Biasing mechanism 302 is configured to bias against an interior of a blowout preventer body when ram 300 is located within a blowout preventer body. For instance, when blowout preventer 300 is located within a blowout preventer body, biasing mechanism 302 biases against an interior of blowout preventer body, thereby resulting in resultant forces acting on blowout preventer ram 300 in the horizontal and, more importantly, vertical directions.

In the illustrated embodiment, biasing mechanism 302 includes a fastening member, 306, a wear pad member 308, a spacer member 310, and a biasing member 312. As noted above, biasing mechanism 302 is shown here in an exploded view to more easily discuss and describe the exemplary elements of biasing mechanism 302. Describing the exemplary elements of biasing mechanism 302 from closest to blowout preventer ram 300 and moving outwardly, biasing member 312 can be any type of structure for biasing wear pad 308 against an interior surface of a blowout preventer body. For instance, biasing member 312 can be a coiled spring, a coned-disc spring, such as a Belleville spring, and a coned disc-washer, such as a Belleville washer. That is, biasing member 312 can be any element which, when energized, biases wear pad 308 against an interior portion of a blowout preventer body.

Above biasing member 312 is a washer or other spacer member 310 providing for space between biasing member 312 and wear pad member 308. Spacer member 310 is configured to more evenly distribute pressure to wear pad member 308 when biasing member 312 is energized. Above spacer member 310 is the wear pad member 308. Wear pad member 308 is configured to contact an interior portion of a blowout preventer body when biasing member 312 is energized. As discussed above with respect to FIG. 2, wear pad member 308 can be of any geometry provided that it is suitable for contacting an interior portion of a blowout preventer body and biasing blowout preventer ram 300 as a result.

Fastening member 306 is passed through an aperture in each of elements 308, 310, and 312, and is configured to coupled biasing member 302 to ram 300. Fastening member 306 can include any type of fastening device known to those of ordinary skill in the art, such as a retention screw. Biasing member 302 can be located within a recess 314 located on an outer surface of blowout preventer ram 300.

Elements 306, 308, 310, and 312 can be present in any number and in any orientation. For instance, biasing member 302 may include one or more fastening members 306 configured to secure biasing member 302 to ram 300. Further, biasing member 302 may include one or more biasing members 312. For example, when biasing mechanism 302 comprises three biasing members 312, each biasing member 312 can be of the same type as the other biasing members 312 (e.g., three coiled springs), each biasing member 312 can be of a different type (e.g., one coiled spring, one coned-disc spring, one coned-disc washer), each biasing member 312 can be same or different from the other biasing members 312 (e.g., two coiled springs, one coned-disc spring), or any combination thereof.

Figure 4:
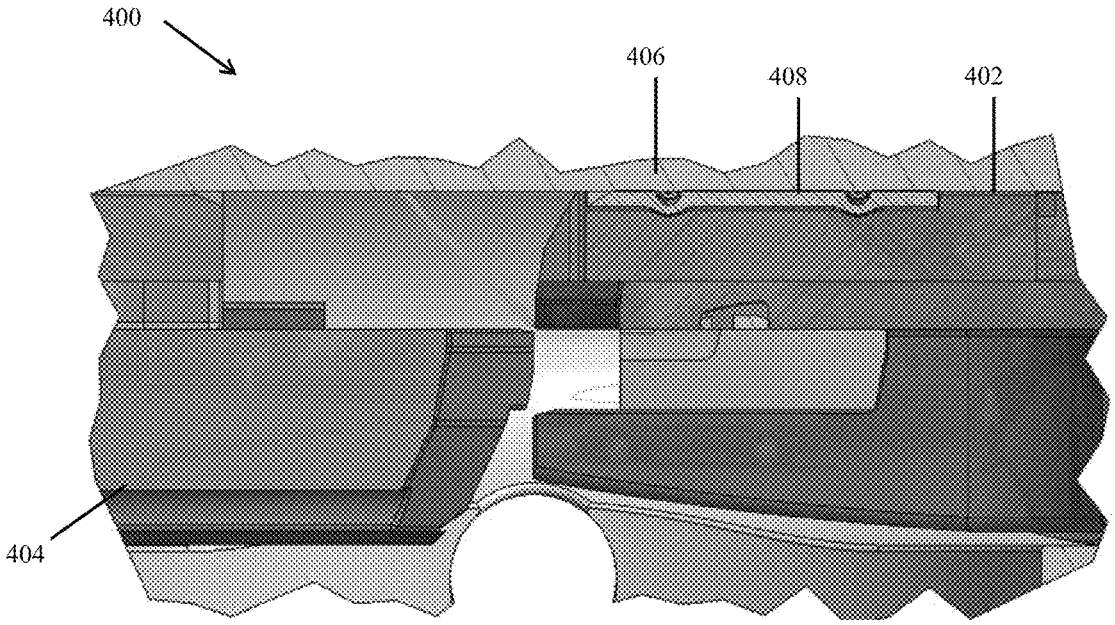
FIG. 4 shows cross-sectional elevation view of a ram assembly including an upper ram with a biasing mechanism and a lower ram.

Turning now to FIG. 4, a cross-sectional elevation view of ram assembly 400 is shown for illustrative purposes. Ram assembly 400 comprises an upper ram 402 and a lower ram 404. Upper ram 402 is similar to ram 24 illustrated in FIGS. 1A through 1C, blowout preventer ram 200 illustrated in FIG. 2, and blowout preventer ram 300 illustrated in FIG. 3. Upper ram 402 and lower ram 404 are located in a blowout preventer body 406. In particular, the portion of blowout preventer body 406 shown is an interior portion of a ram cavity located within blowout preventer body 406. Blowout preventer body 406 further includes a vertical bore, not shown, but generally known to those of ordinary skill in the art.

Upper ram 402 and lower ram 404 are configured to be moved into and out of engagement with each other in order to shear an object located in the blowout preventer vertical bore. As upper ram 402 moves toward lower ram 404, biasing mechanism 408 biases against the interior of blowout preventer body 406. Biasing mechanism 408 is configured to provide a bias force as upper ram 402 travels along the entire length of the ram cavity, i.e., biasing mechanism 408 is in contact with, and biasing against, an interior portion of blowout preventer body 406 as upper ram 402 travels along the entire ram cavity. In this way, biasing mechanism 408 imparts a generally downward force onto upper ram 402 as it travels within the ram cavity, thereby reducing an axial gap, if any, between the cutting surfaces of upper ram 402 and lower ram 404. Reducing the axial gap between upper ram 402 and lower ram 404 creates a scissoring effect, thereby allowing for more efficient shearing of an object in the bore of the blowout preventer.

Inclusion of a biasing mechanism onto a shear ram allows for easier shearing of an object in the bore of the blowout preventer after the shear rams have already been used on one or more previous occasions. This is because, as discussed above, shear rams have a tendency to develop an axial gap between the cutting surfaces of each respective ram after shearing an object. As the rams are used to shear subsequent objects, the axial gap can further increase. When trying to shear a particularly-difficult object, such as wireline, which has a tendency to stretch rather than shear, the axial gap between cutting surfaces can be problematic. By including a biasing mechanism, such as biasing mechanism 408, the axial gap between rams can be reduced and such objects can more efficiently be sheared.

As discussed above, a ram and a blowout preventer in accordance with the present disclosure may be used to shear one or more objects, including a casing joint, a drill pipe joint, a tool joint, and a wireline, with each having various shapes, sizes, and/or other dimensions. A casing joint may have one or more sizes, such as an outer diameter of about 16 inches (about 40.6 centimeters), about 14 inches (about 35.6 centimeters), about 12 inches (about 30.5 centimeters), and/or about 10.625 inches (about 26.99 centimeters). Further, a drill pipe joint may have one or more sizes, such as an outer diameter of about 6.625 inches (about 16.83 centimeters), about 5.5 inches (about 14.0 centimeters), and/or about 3.5 inches (about 8.9 centimeters). Moreover, wireline may have one or more sizes, such as an outer diameter of about 3/16 inches (about 0.47 centimeters), about 0.25 inches (about 0.64 centimeters), about 0.5 inches (about 1.28 centimeters), and so on. As such, rams and ram blades of different sizes may be selected to shear on a particular object. Inclusion of a biasing mechanism as discussed above will enhance shearing efficiency in any arrangement.

In addition to the embodiments described above, many examples of specific combinations are within the scope of the disclosure, some of which are detailed below:

Example 1

A shear ram positioned in a blowout preventer body, the shear ram comprising:

a ram body including a shear blade configured to shear an object located in a vertical bore of the blowout preventer body; and a biasing mechanism configured to bias against an interior surface of the blowout preventer body.

Example 2

The shear ram of Example 1, wherein the biasing mechanism comprises a wear pad located on an outer surface of the ram body and a biasing element positioned between the ram body and the wear pad, the biasing element configured to bias the wear pad against the interior surface of the blowout preventer body.

Example 3

The shear ram of Example 2, further comprising a plurality of wear pads located on the outer surface of the ram body.

Example 4

The shear ram of Example 2, wherein the biasing element is one or more of a coiled spring, a coned-disc spring, and a coned disc-washer.

Example 5

The shear ram of Example 2, further comprising a plurality of biasing elements.

Example 6

The shear ram of Example 1, wherein the object is at least one of a drill pipe joint, a casing joint, a tool joint, and a wireline, such that the shear ram is configured to shear each of the drill pipe joint, the casing joint, the tool joint, and the wireline.

Example 7

The shear ram of Example 1, wherein the biasing mechanism is located on top of the ram body.

Example 8

The shear ram of Example 1, wherein the biasing mechanism is located on bottom of the ram body.

Example 9

The shear ram of Example 1, wherein the biasing mechanism is further configured to urge the shear ram into axial engagement with an opposing shear ram.

Example 10

The shear ram of Example 9, wherein the opposing ram also has a biasing mechanism configured to urge the opposing shear ram into axial engagement with the shear ram.

Example 11

A blowout preventer apparatus comprising:

a body comprising a vertical bore extending through the housing and a ram cavity intersecting the bore;

a pair of opposing hydraulically actuated shear rams comprising a first shear ram and a second shear ram each configured to shear an object located in the vertical bore, the first ram comprising a biasing mechanism configured to bias against an interior surface of the blowout preventer body to urge the first shear ram into axial engagement with the second shear ram.

Example 12

The blowout preventer apparatus of Example 11, the first shear ram further comprising an upper cutting face and the second shear ram further comprising a lower cutting face, wherein the upper and lower cutting faces are configured to interlock.

Example 13

The blowout preventer apparatus of Example 11, wherein the biasing mechanism comprises a wear pad located on an outer surface of the first shear ram and a biasing element positioned between the first shear ram and the wear pad, the biasing element configured to bias the wear pad against the interior surface of the blowout preventer body.

Example 14

The blowout preventer apparatus of Example 13, further comprising a plurality of wear pads located on the outer surface of the first shear ram.

Example 15

The blowout preventer apparatus of Example 13, further comprising a plurality of biasing elements.

Example 16

The blowout preventer apparatus of Example 13, wherein the second shear ram has a biasing mechanism configured to urge the second shear ram into axial engagement with the first shear ram.

Example 17

The blowout preventer apparatus of Example 16, wherein the second shear ram biasing mechanism is located on the bottom of the second shear ram.

Example 18

The blowout preventer apparatus of Example 11, wherein the object is at least one of a drill pipe joint, a casing joint, a tool joint, and a wireline, such that the first shear ram and second shear ram are configured to shear each of the drill pipe joint, the casing joint, the tool joint, and the wireline.

Example 19

The blowout preventer apparatus of Example 11, wherein the biasing mechanism can be retrofittedly coupled to the first shear ram.

Example 20

The blowout preventer apparatus of claim 11, wherein the biasing mechanism is further configured to urge the first shear ram into axial engagement with the second shear ram.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A shear ram positionable in a blowout preventer ("BOP") body to shear an object located in a vertical bore of the BOP body, the shear ram comprising:

a ram body configured to move within the BOP body and including a shear blade configured to shear the object; and a biasing mechanism configured to bias against an interior surface of the BOP body, the biasing mechanism comprising:

a wear pad carried by the ram body and configured to move with respect to an outer surface of the ram body; and a biasing element carried by the ram body and configured to bias the wear pad against the interior surface of the BOP body.

2. The shear ram of claim 1, further comprising a plurality of wear pads located on the outer surface of the ram body.

3. The shear ram of claim 1, wherein the biasing element comprises one or more of a coiled spring, a coned-disc spring, and a coned disc-washer.

4. The shear ram of claim 1, further comprising a plurality of biasing elements.

5. The shear ram of claim 1, wherein the object is at least one of a drill pipe joint, a casing joint, a tool joint, and a wireline, such that the shear ram is configured to shear each of the drill pipe joint, the casing joint, the tool joint, and the wireline.

6. The shear ram of claim 1, wherein the biasing mechanism is located on top of the ram body.

7. The shear ram of claim 1, wherein the biasing mechanism is located on bottom of the ram body.

8. The shear ram of claim 1, wherein the biasing mechanism is further configured to force the shear ram into axial engagement with an opposing shear ram during shearing operations.

9. The shear ram of claim 8, wherein the opposing ram also comprises a biasing mechanism configured to force the opposing shear ram into axial engagement with the shear ram during shearing operations.

10. The shear ram of claim 1, wherein the interior surface is a surface of a ram cavity.

11. A blowout preventer ("BOP") apparatus comprising:

a body comprising a vertical bore extending through the body and a ram cavity intersecting the bore;

a pair of opposing hydraulically actuated shear rams comprising a first shear ram and a second shear ram each configured to move within the BOP body and shear an object located in the vertical bore, the first ram comprising a biasing mechanism configured to bias against an interior surface of the BOP body to urge the first shear ram into axial engagement with the second shear ram, the biasing mechanism comprising:

a wear pad carried by the first ram and configured to move with respect to an outer surface of the first ram; and a biasing element carried by the first ram and configured to bias the wear pad against the interior surface of the BOP body.

12. The blowout preventer apparatus of claim 11, the first shear ram further comprising an upper cutting face and the second shear ram further comprising a lower cutting face, wherein the upper and lower cutting faces are configured to interlock during shearing operations.

13. The blowout preventer apparatus of claim 11, further comprising a plurality of wear pads located on the outer surface of the first shear ram.

14. The blowout preventer apparatus of claim 11, further comprising a plurality of biasing elements.

15. The blowout preventer apparatus of claim 11, wherein the second shear ram has a biasing mechanism configured to force the second shear ram into axial engagement with the first shear ram.

16. The blowout preventer apparatus of claim 15, wherein the second shear ram biasing mechanism is located on the bottom of the second shear ram.

17. The blowout preventer apparatus of claim 11, wherein the object is at least one of a drill pipe joint, a casing joint, a tool joint, and a wireline, such that the first shear ram and second shear ram are configured to shear each of the drill pipe joint, the casing joint, the tool joint, and the wireline.

18. The blowout preventer apparatus of claim 11, wherein the biasing mechanism is configured to be retrofittedly coupled to the first shear ram.

19. The blowout preventer apparatus of claim 11, wherein the biasing mechanism is further configured to force the first shear ram into axial engagement with the second shear ram.

* * * * *